US011116045B2

(12) United States Patent
Boehmer et al.

(10) Patent No.: US 11,116,045 B2
(45) Date of Patent: Sep. 7, 2021

(54) VARIABLE PITCH RESISTANCE COIL HEATER

(71) Applicant: Watlow Electric Manufacturing Company, St. Louis, MO (US)

(72) Inventors: Scott Boehmer, Hannibal, MO (US); Dennis P. Long, Monroe City, MO (US); Rolando O. Juliano, Vista, CA (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 409 days.

(21) Appl. No.: 16/292,863

(22) Filed: Mar. 5, 2019

(65) Prior Publication Data

US 2019/0200418 A1 Jun. 27, 2019

Related U.S. Application Data

(60) Division of application No. 15/099,999, filed on Apr. 15, 2016, now Pat. No. 10,477,622, which is a continuation-in-part of application No. 14/744,654, filed on Jun. 19, 2015, now Pat. No. 9,345,070, which is a continuation of application No. 13/481,667, filed on May 25, 2012, now Pat. No. 9,113,501.

(51) Int. Cl.

| | |
|---|---|
| ***F24H 1/10*** | (2006.01) |
| ***H01C 3/08*** | (2006.01) |
| ***H05B 3/08*** | (2006.01) |
| ***H05B 3/12*** | (2006.01) |
| ***H05B 3/44*** | (2006.01) |
| ***H05B 3/48*** | (2006.01) |
| ***H05B 3/82*** | (2006.01) |
| ***H05B 3/06*** | (2006.01) |
| ***H05B 3/42*** | (2006.01) |
| ***H05B 3/52*** | (2006.01) |

(52) U.S. Cl.

CPC ..... *H05B 3/06* (2013.01); *F24H 1/102* (2013.01); *H01C 3/08* (2013.01); *H05B 3/42* (2013.01); *H05B 3/48* (2013.01); *H05B 3/52* (2013.01); *H05B 3/82* (2013.01); *H05B 2203/014* (2013.01); *H05B 2203/037* (2013.01)

(58) Field of Classification Search

None

See application file for complete search history.

(56) References Cited

U.S. PATENT DOCUMENTS 2,627,018 A * 1/1953 Duren ..... H05B 3/342 219/527

3,471,682 A * 10/1969 Kyle ..... H05B 3/0057 219/388

(Continued)

*Primary Examiner* — Joseph M. Pelham

(74) *Attorney, Agent, or Firm* — Burris Law, PLLC

(57) ABSTRACT

A heater includes a first conducting pin, a second conducting pin, and a plurality of resistance coils. Each resistance coil includes a first end connected to the first conducting pin and a second end connected to the second conducting pin. At least one resistance coil among the plurality of resistance coils has a continuously variable pitch. In one form, the plurality of resistance coils are connected in a parallel circuit with the first and second conducting pin. A first resistance coil among the plurality of resistance coils may have a diameter that is different than a second resistance coil among the plurality of resistance coils.

20 Claims, 13 Drawing Sheets

(56) References Cited

U.S. PATENT DOCUMENTS

| | | | | |
|---|---|---|---|---|
| 5,310,979 | A * | 5/1994 | Jung | H05B 6/6482 219/680 |
| 5,386,491 | A * | 1/1995 | Mewissen | A47J 37/0623 219/411 |
| 8,410,406 | B1 * | 4/2013 | Kutz | H05B 3/06 219/542 |
| 8,791,396 | B2 * | 7/2014 | Burns | C10G 1/008 219/542 |
| 9,113,501 | B2 * | 8/2015 | Long | H05B 3/48 |
| 2011/0292144 | A1 * | 12/2011 | Gellida | B41J 11/002 347/102 |
| 2012/0018420 | A1 * | 1/2012 | Whitney | H05B 6/56 219/544 |
| 2014/0231412 | A1 * | 8/2014 | Fowler | H05B 3/16 219/552 |
| 2016/0295641 | A1 * | 10/2016 | Boehmer | F24H 1/102 |
| 2021/0112629 | A1 * | 4/2021 | Schlipf | H05B 3/42 |
| 2021/0112632 | A1 * | 4/2021 | Schlipf | H05B 3/40 |

* cited by examiner

VARIABLE PITCH RESISTANCE COIL HEATER

CROSS-REFERENCE TO RELATED APPLICATIONS

This application is a divisional of U.S. patent application Ser. No. 15/099,999, filed on Apr. 15, 2016, which is a continuation-in-part of U.S. patent application Ser. No. 14/744,654, filed on Jun. 19, 2015, which is a continuation application of Ser. No. 13/481,667, filed on May 25, 2012, now U.S. Pat. No. 9,113,501. The disclosures of the above applications is incorporated herein by reference.

FIELD

The present disclosure relates to electric heaters, and more specifically to electric heaters that use resistance coils to generate heat.

BACKGROUND

The statements in this section merely provide background information related to the present disclosure and may not constitute prior art.

Tubular heaters generally include a resistance coil, an insulating material surrounding the resistance coil, and a tubular sheath surrounding the insulating material. The resistance coil is connected to a pair of conducting pins which protrude from the tubular sheath for connecting to a power source. The resistance coil generates heat, which is transferred to the tubular sheath, which in turn heats a surrounding environment or part.

Tubular heaters are commonly used in heat exchangers. The heat capacity rate of the heat exchanger depends on the heat generation capability of the tubular heater, particularly, the resistance coil. To increase the heat capacity rate of the heat exchanger, more tubular heaters may be provided in the heat exchanger, resulting in a bulky structure. Moreover, heat exchangers using the typical tubular heaters may have performance problems such as increased hydrocarbons and severe fouling at an outlet due to overheating, which eventually leads to failure.

SUMMARY

In one form, the present disclosure provides a heater that includes a first conducting pin, a second conducting pin, and a plurality of resistance coils. Each resistance coil includes a first end connected to the first conducting pin and a second end connected to the second conducting pin, wherein at least one resistance coil of the plurality of resistance coils has a continuously variable pitch.

In another form, the first and second conducting pins extend in a first direction and are parallel to each other. In this form, the plurality of resistance coils may be disposed between the first and second conducting pins.

In another form, one resistance coil among the plurality of resistance coils has a different diameter than another one of the resistance coils of the plurality of resistance coils.

In yet another form, one of the resistance coils of the plurality of resistance coils has a different diameter and a different pitch than another one of the resistance coils of the plurality of resistance coils.

In another form, each resistance coil among the plurality of resistance coils has a variable pitch from its respective first end to its respective second end.

In other forms, one of the resistance coils among the plurality of resistance coils may have a variable diameter, one of the resistance coils among the plurality of resistance coils has a variable diameter and a variable pitch, and one or each of the resistance coils among the plurality of resistance coils has a constant diameter.

In another form, the plurality of resistance coils are aligned axially along a first direction to define a plurality of heating zones.

In a further form, the present disclosure further provides a heater that includes a first conducting pin, a second conducting pin, and a plurality of resistance coils connected in a parallel circuit with the first and second conducting pins such that each resistance coil includes a first end connected to the first conducting pin and a second end connected to the second conducting pin. The plurality of resistance coils are aligned along a first direction to define a plurality of heating zones and a first resistance coil among the plurality of resistance coils has a continuously variable pitch or a diameter that is different than a second resistance coil of the plurality of resistance coils.

In one form, the first and second conducting pins extend in the first direction and are parallel to each other, and wherein the plurality of resistance coils are disposed between the first and second conducting pins.

In another form, the first resistance coil has a different diameter than the second resistance coil.

In another form, each resistance coil of the plurality of resistance coils has a different diameter.

In yet another form, the first resistance coil has a continuously variable pitch from its first end to its second end.

In still another form, each resistance coil of the plurality of resistance coils has a variable pitch from its respective first end to its respective second end.

In another form, the plurality of zones includes at least three zones. In this form, the plurality of resistance coils may be aligned axially along the first direction.

In another form, at least one resistance coil of the plurality of resistance coils has a constant diameter.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

In order that the invention may be well understood, there will now be described an embodiment thereof, given by way of example, reference being made to the accompanying drawing, in which.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
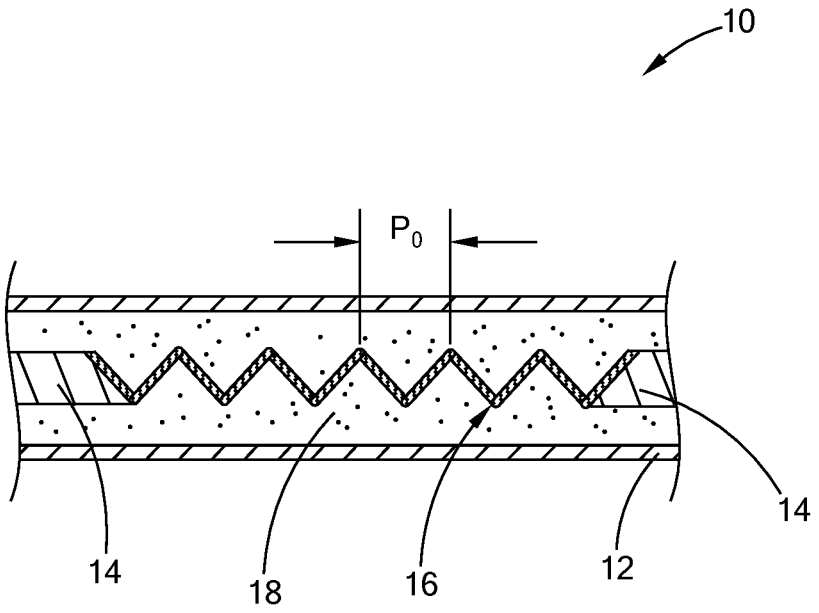
FIG. 1 PRIOR ART
FIG. 1 is a cross-sectional view of a prior art tubular heater.

Referring to FIG. 1, a typical tubular heater 10 generally includes a tubular outer sheath 12, a pair of conducting pins 14 protruding from opposing ends of the tubular outer sheath 12, a resistance coil 16 disposed between the conducting pins 14, and an insulating material 18. The resistance coil 16 generally includes resistance-type metal alloy and is formed into a helical coil shape. The resistance coil 16 generally has a constant pitch $P_0$ along the length of the resistance coil 16 to provide uniform heating along the length of the tubular outer sheath 12. The insulating material 18, such as magnesium oxide, is provided inside the tubular outer sheath 12 to surround and electrically insulate the resistance coil 16.

Figure 2:
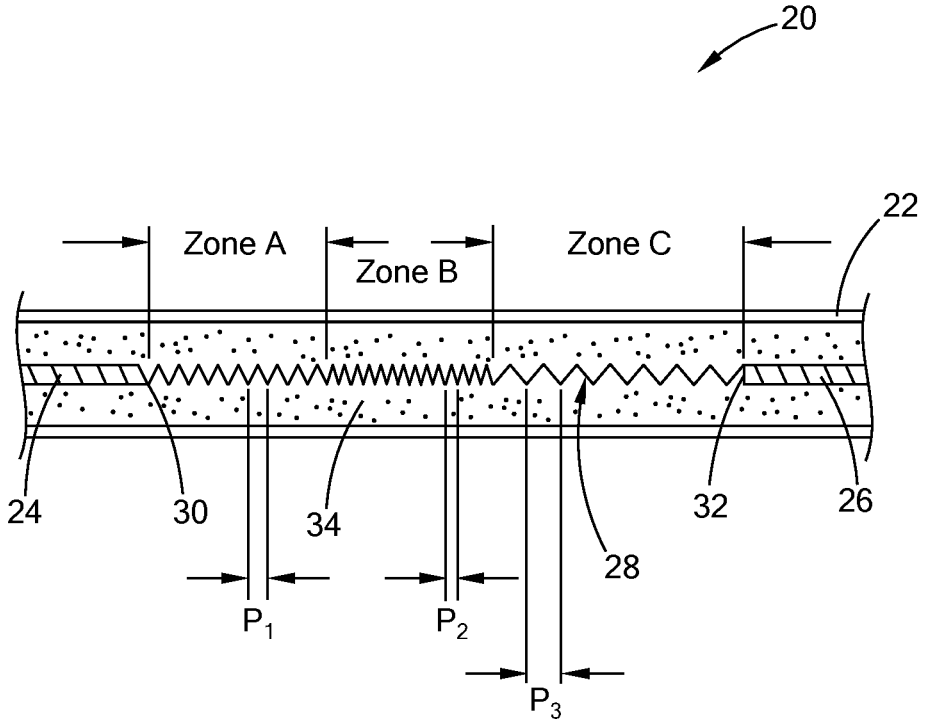
FIG. 2 is a cross-sectional view of a tubular heater constructed in accordance with the teachings of the present disclosure.

Referring to FIG. 2, a tubular heater 20 constructed in accordance with the teachings of the present disclosure includes a tubular outer sheath 22, first and second conducting pins 24 and 26, and a resistance coil 28 disposed between the first and second conducting pins 24 and 26. The resistance coil 28 includes helical coils having a constant outside diameter. The resistance coil 28 has a first end 30 connected to the first conducting pin 24 and a second end 32 connected to the second conducting pin 26. The resistance coil 28 and the first and second conducting pins 24 and 26 form a resistance coil assembly. The resistance coil 28 defines a plurality of zones having different pitches. While three zones A, B, C are shown, it is understood that the resistance coil 28 may have any number of zones without departing from the scope of the present disclosure.

As shown, the resistance coil 28 has pitches $P_1$, $P_2$, and $P_3$ in zones A, B, and C, respectively. $P_3$ is greater than $P_1$, and $P_1$ is greater than $P_2$. The resistance coil 28 has a constant pitch along the length of each zone. A first zone A with a pitch $P_1$ is provided proximate the first end portion 30. A second zone B with a pitch $P_2$ is provided at a middle portion and adjacent the first zone A. A third zone C with a pitch $P_3$ is provided adjacent the second zone B and the second end portion 32. The plurality of different pitches $P_1$, $P_2$, and $P_3$ in the plurality of zones A, B and C provide a variable watt density such that a predetermined temperature profile is provided along the length of the tubular outer sheath 22. The pitches $P_1$, $P_2$ and $P_3$ in zones A, B and C are determined based on a desired temperature profile along the length of the outer tubular sheath 22. The predetermined temperature profile may be constant to provide uniform heating along the length of the outer tubular sheath 22. Alternatively, the predetermined temperature profile may be varied to provide varied heating along the length of the outer tubular sheath 22, taking into account the heat sinks proximate the outer tubular sheath 22 or the temperature gradient of the fluid along the outer tubular sheath 22. The plurality of different pitches may be, by way of example, in the range of approximately 1.5 inches (38.1 mm) to approximately 4.5 inches (114.3 mm). An insulating material 34 surrounds the resistance coil 28 and fills in the tubular outer sheath 22. The insulating material 34 is a compacted Magnesium Oxide (MgO) in one form of the present disclosure. In other forms, an insulating material such as MgO may be mixed with other materials such as Boron Nitride (BN) in order to improve heat transfer characteristics. It should be understood that these insulating materials 34 are exemplary and thus should not be construed as limiting the scope of the present disclosure.

Figure 3:
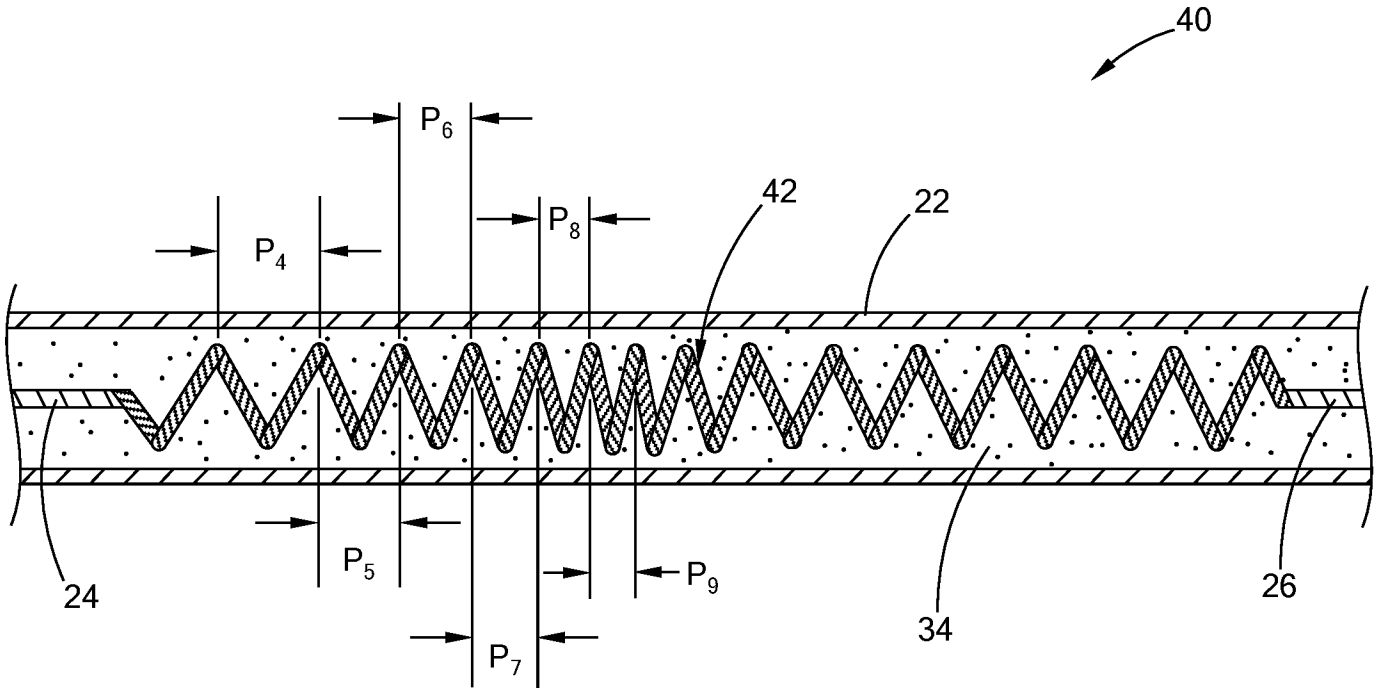
FIG. 3 is a cross-sectional view of another form of a tubular heater constructed in accordance with the teachings of the present disclosure.

Referring to FIG. 3, a tubular heater 40 constructed in accordance with the teachings of the present disclosure has a structure similar to that of FIG. 2, except for the resistance coil 42. The resistance coil 42 in this embodiment has a continuously variable pitch with the ability to accommodate an increasing or decreasing pitch $P_4$-$P_8$ on the immediately adjacent next 360 degrees coil loop. The continuously variable pitch of the resistance coil 42 allows the resistance coil 42 to provide gradual changes in the flux density of a heater surface (i.e., the surface of the outer tubular sheath 22).

The resistance coil 28 with different pitches ($P_1$, $P_2$, $P_3$) in different zones A, B, C or the resistance coil 42 with continuously variable pitches ($P_4$ to $P_8$) may be produced by using a constant-pitch coil. A knife-edge-like device is used to hold the opposing ends of a section/zone of the coil and stretch or compress the coil in the same section/zone to the desired length to adjust the pitch in the section/zone. The resistance coil 28 may include a material such as nichrome and may be formed by using nichrome resistance wire in the full annealed state or in a "full hard" condition. The hardness of a metal is directly proportional to the uniaxial yield stress. A harder metal has higher resistance to plastic deformation and thus aids the process of producing the coil with the desired zoned-pitch or continuously variable pitch. In addition to nichrome 80/20, other resistance alloys may be used to form resistance coils with zoned-pitch or continuously variable pitch. When nichrome is used, the pitch of the coil may be in a range of approximately 0.5 to approximately 2.5 times the diameter of the resistance coil 28. When other materials are used for the resistance coil 28, the coil may have a larger or smaller pitch range, and thus the values set forth herein are merely exemplary and should not be construed as limiting the scope of the present disclosure.

The resistance wire that is used to form the resistance coil 28 or 42 may have a cross section of any shape, such as circular, rectangular, or square without departing from the scope of the present disclosure. A non-circular cross section is likely to exhibit better resistance to plastic deformation.

Figure 4:
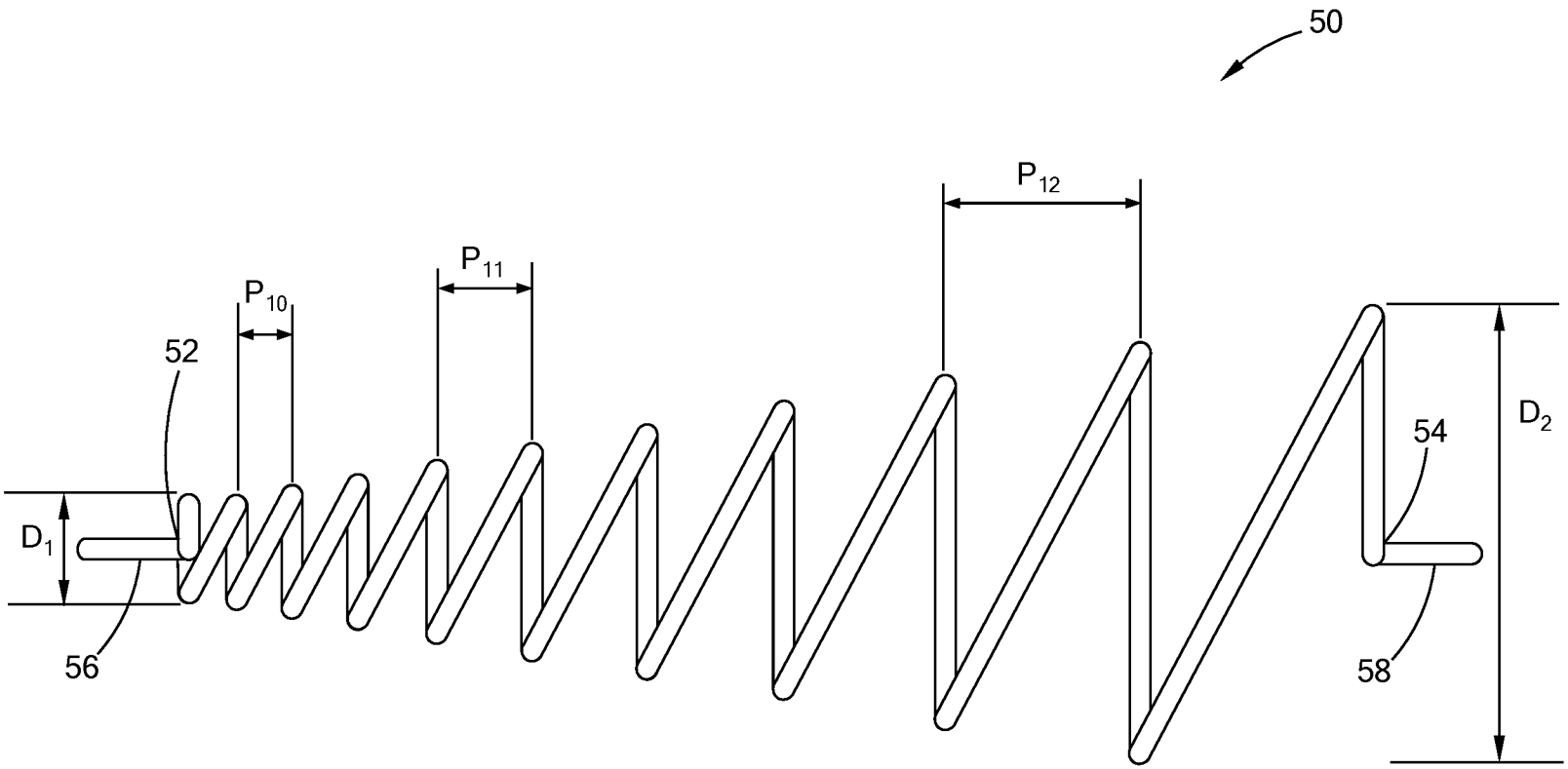
FIG. 4 is a schematic view of a resistance coil that can be used in a tubular heater constructed in accordance with the teachings of the present disclosure.
Figure 5:
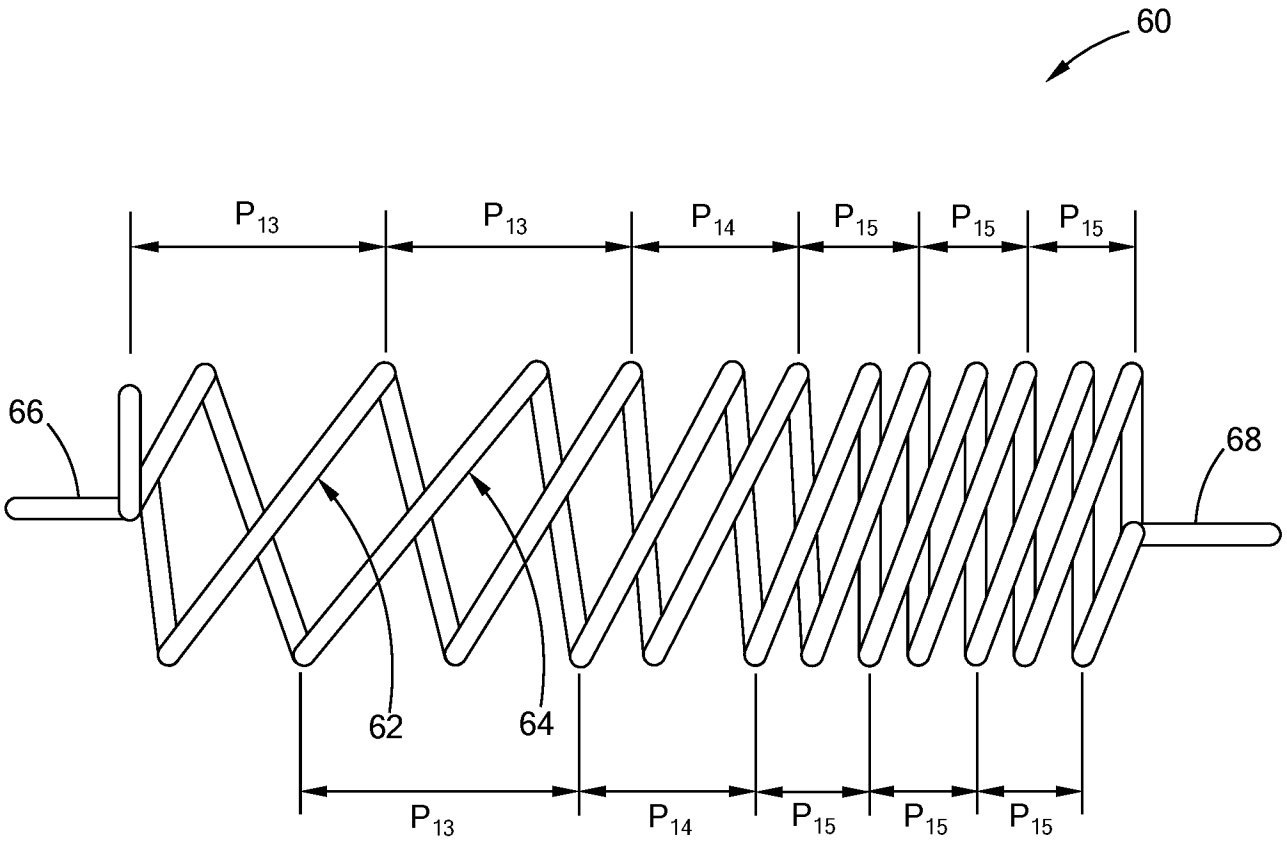
FIG. 5 is a schematic view of another form of a resistance coil having a continuously variable pitch that can be used in a tubular heater constructed in accordance with the teachings of the present disclosure.
Figure 6:
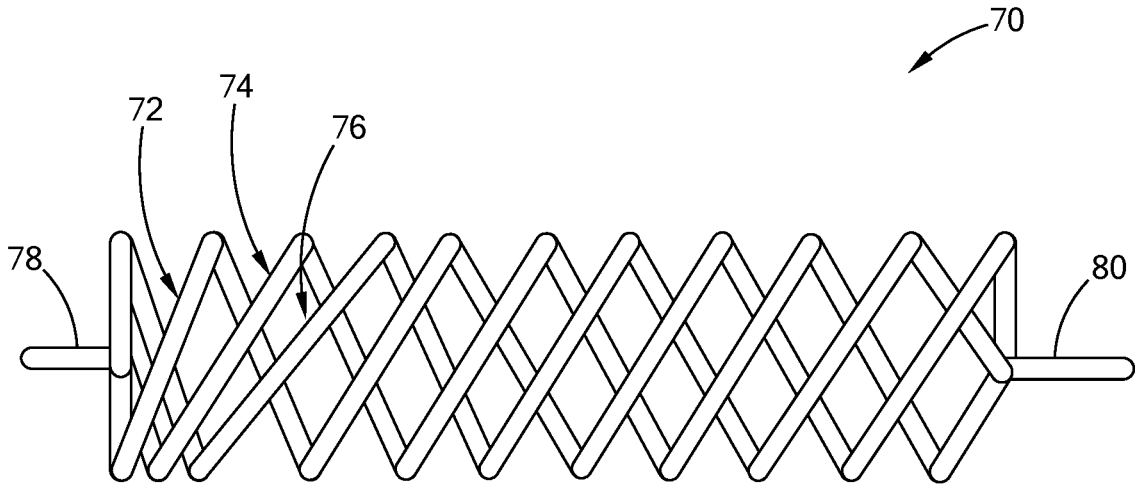
FIG. 6 is a schematic view of still another form of a resistance coil that can be used in a tubular heater constructed in accordance with the teachings of the present disclosure.

Referring to FIGS. 4 to 6, the resistance coil 28 may have a different configuration. As shown in FIG. 4, the resistance coil 50 may have a conical shape with varied outside diameters. For example, the resistance coil 50 may have the smallest outside diameter $D_1$ at a first end 52 proximate a first conducting pin 56 and have the largest outside diameter $D_2$ at a second end 54 proximate a second conducting pin 58. The resistance coil 50 may have a zoned-pitch or continuously variable pitches ($P_{10}$-$P_{12}$) along the length of the resistance coil 50.

The resistance coil may alternatively have double-helix or triple-helix as shown in FIGS. 5 and 6, respectively. In FIG. 5, the resistance coil 60 has a double helix and includes a first helix element 62 and a second helix element 64. The first and second helix elements 62 and 64 are formed around the same axis and connected to the first and second conducting pins 66 and 68 to form a parallel circuit. The first and second helix elements 62 and 64 may have zoned-pitches ($P_{13}$, $P_{14}$, $P_{15}$) or continuously-variable pitch. In FIG. 6, the resistance coil 70 is shown to have a triple helix and includes a first helix element 72, a second helix element 74 and a third helix element 76, which are connected to a first conducting pin 78 and a second conducting pin 80 to form a parallel circuit.

Figure 7:
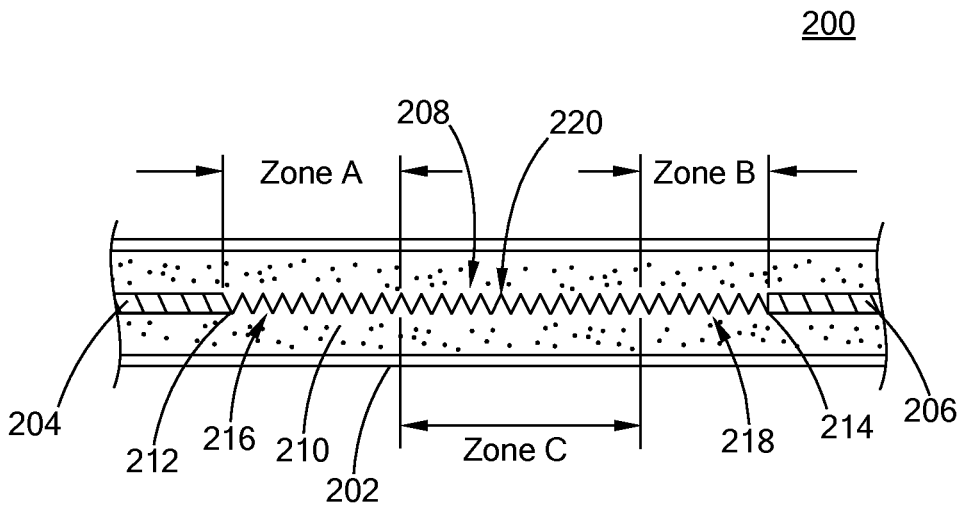
FIG. 7 is a cross-sectional view of another form of a tubular heater constructed in accordance with the teachings of the present disclosure.

Referring to FIG. 7, another form of a tubular heater 200 constructed in accordance with the teachings of the present disclosure includes an outer sheath 202, which may be tubular in one form of the present disclosure, first and second conducting pins 204 and 206, a resistance coil 208 disposed between the first and second conducting pins 204 and 206, and an insulating material 210 filled in the tubular outer sheath 202 to electrically insulate the resistance coil 208. In this form, the resistance coil 208 includes helical coils having a constant outside diameter. The resistance coil 208 includes a first end 212 connected to the first conducting pin 204, and a second end 214 opposing the first end 212 and connected to the second conducting pin 206. The resistance coil 208 has a first portion 216 adjacent the first end 212, a second portion 218 adjacent the second end 214, and a third portion 220 disposed between the first portion 216 and a second portion 218. The first, second and third portions 216, 218 and 220 may have different pitches to provide different watt density/heat output density. Therefore, the first, second and third portions 216, 218 and 220 define a plurality of heating zones A, B, and C. While only three zones A, B, C are shown, it is understood that the resistance coil 208 may have any number of heating zones without departing from the scope of the present disclosure.

At least one of the first, second, and third portions 216, 218 and 220 may have a continuously variable pitch. In one form, the first and second portions 216 and 218 have a constant pitch, whereas the third portion 220 has a continuously variable pitch. The pitch of the first portion 216 may be equal to or different from the pitch of the second portion 218. The pitch of the first portion 216 and the second portion 218 may be greater than or smaller than the pitch of the third portion 220. Therefore, the first and second portions 216 and 218 of the resistance coil 208 generate constant watt density in the heating zone A and the heating zone B, whereas the third portion 220 of the resistance coil 208 generates variable watt density/heat output density in the heating zone C.

Alternatively, the first, second and third portions 216, 218 and 220 each have a continuously variable pitch. Therefore, the heating zones A, B and C each generate a variable watt density.

Figure 8:
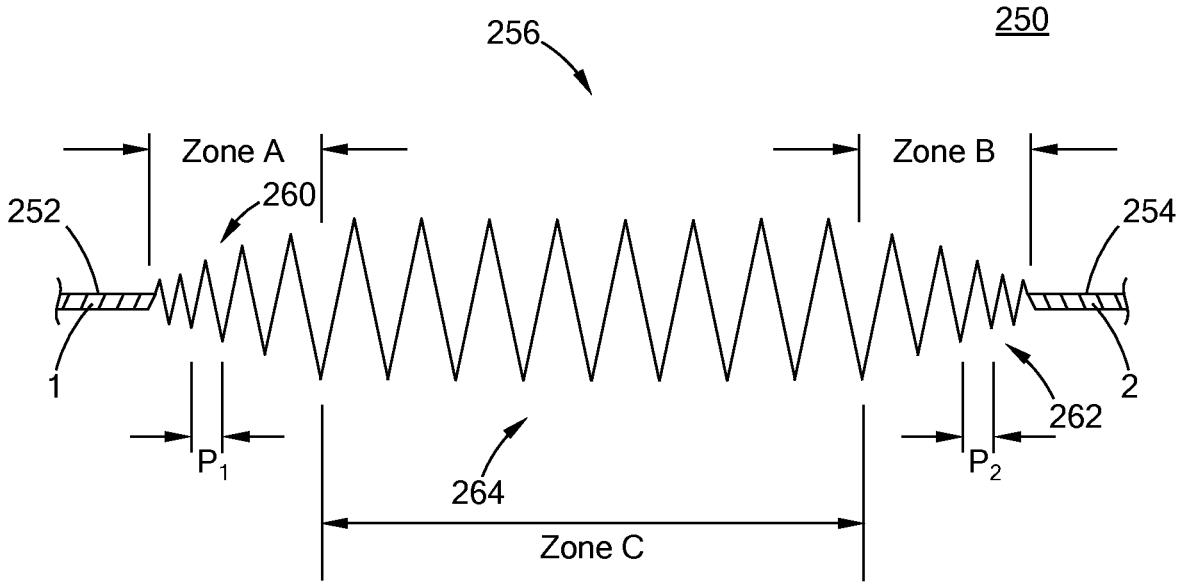
FIG. 8 is a schematic view of another form of a tubular heater constructed in accordance with the teachings of the present disclosure, wherein an outer sheath and insulating materials are removed for clarity.

Referring to FIG. 8, a tubular heater 250 constructed in accordance with the teachings of the present disclosure includes first and second conducting pins 252 and 254, and a resistance coil 256 disposed between the first and second conducting pins 252 and 254. The resistance coil 256 has a first end connected to the first conducting pin 252, and a second end connected to the second conducting pin 252. The resistance coil 256 includes a first portion 260 connected to the first conducting pin 252, a second portion 262 connecting to the second conducting pin 254, and a third portion 264 disposed between the first and second portions 260, 262. The first, second, and third sections 264, 262, 264 have different pitches and/or diameters and thus define three heating zones A, B, and C.

The first portion 260 of the resistance coil 256 has a constant pitch $P_1$ and a variable diameter, which gradually increases from the first conducting pin 252 to the third portion 264 to define a taper. The second portion 262 of the resistance coil 256 has a constant pitch $P_2$ and a variable diameter, which gradually increases from the second conducting pin 254 to the third portion 264 to define a taper. Therefore, despite the constant pitches of the first and second portions 260 and 262, the heating zones A and B can provide variable watt density.

The third portion 264 of the resistance coil 256 may be configured to have continuously variable pitch and a constant diameter. Therefore, the heating zone C also provides a variable watt density and consequently a variable heat output density to provide a desired heating profile for a heating target.

Figure 9:
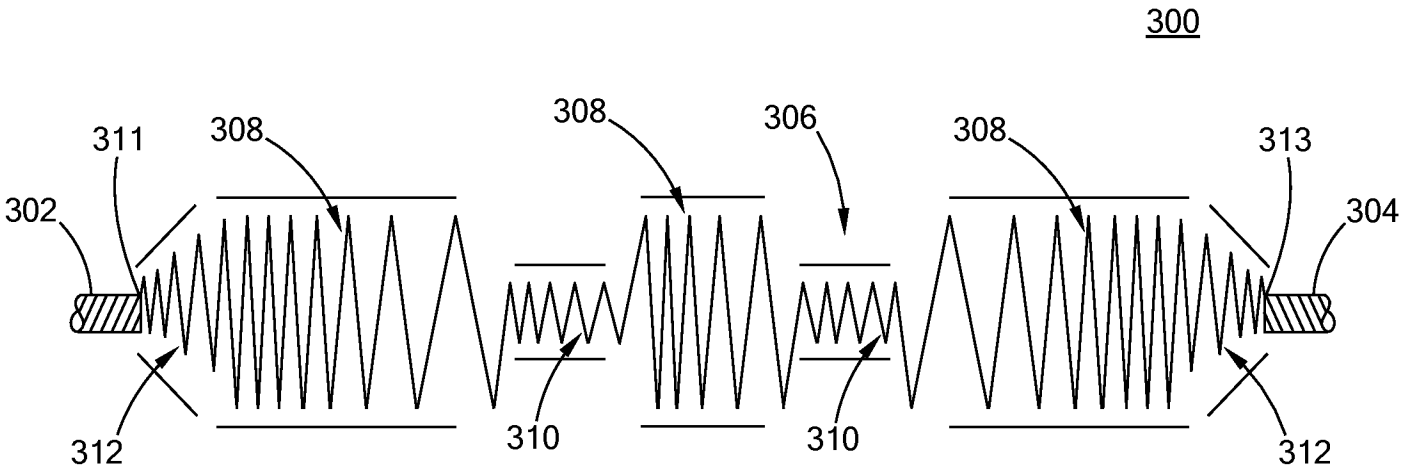
FIG. 9 is a schematic view of still another form of a tubular heater constructed in accordance with the teachings of the present disclosure, wherein an outer sheath and insulating materials are removed for clarity.

Referring to FIG. 9, a tubular heater 300 constructed in accordance with the teachings of the present disclosure includes a first conducting pin 302, a second conducting pin 304, and a resistance coil 306 disposed between and connected to the first and second conducting pins 302 and 304. The resistance coil 306 includes a plurality of first portions 308 having a first diameter, a plurality of second portions 310 having a second diameter smaller than the first diameter, and third portions 312. The first and second portions 308 and 310 may be alternately disposed, or "alternately arranged," along the length of the resistance coil 306. The third portions 312 are disposed adjacent opposing first and second ends 311, 313 of the resistance coil 306 and form a taper. The third portions 312 each have a variable diameter, which gradually increases from the first conducting pin 302 or the second conducting pin 304 to an adjacent first portion 308. The first and second portions 308 and 310 each have a variable pitch to provide variable watt density/heat output density.

FIG. 9 shows three first portions 308 having a constant diameter. The first portion 308 closest to the first conducting pin 302 may have a continuously variable pitch, which gradually increases as it is closer to a center of the resistance coil 306. The first portion 308 closest to the second conducting pin 304 may have a continuously variable pitch, which gradually increases as it is closer to the center of the resistance coil 306. The first portion 308 adjacent to the center of the resistance coil 306 may have a constant pitch or a variable pitch, which may be different from the variable pitch of the first portions 308 at the opposing ends 311, 313.

Figure 10:
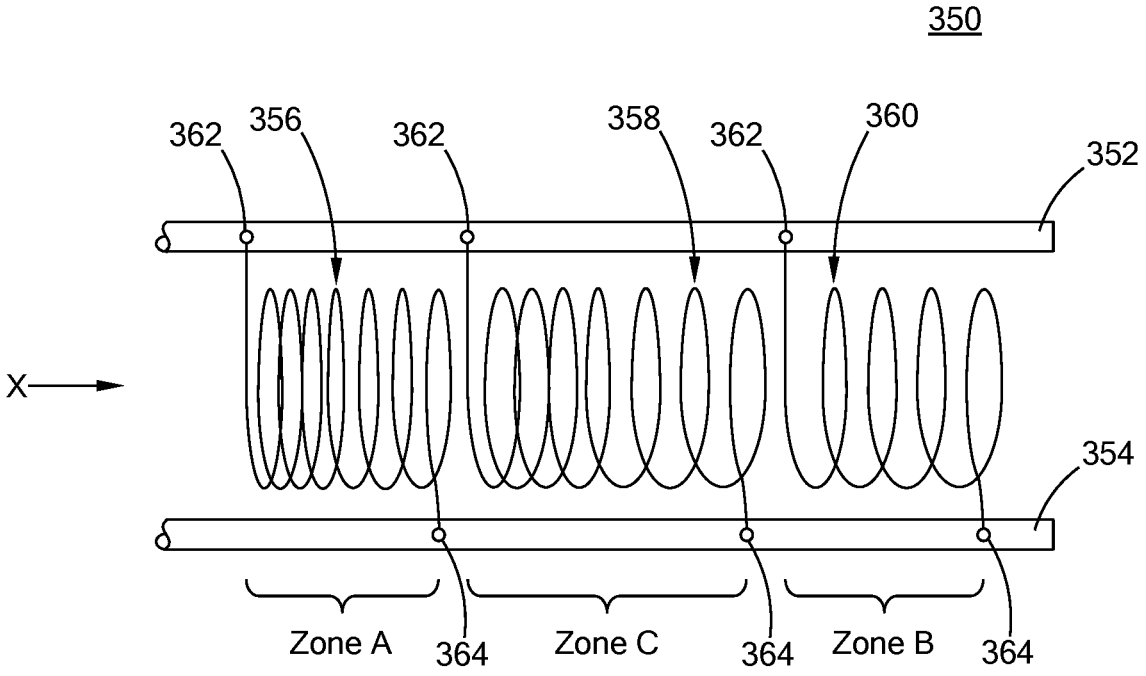
FIG. 10 is a schematic view of still another form of a tubular heater constructed in accordance with the teachings of the present disclosure, wherein an outer sheath and insulating material are removed for clarity.

Referring to FIG. 10, a tubular heater 350 constructed in accordance with the teachings of the present disclosure includes a first conducting pin 352, a second conducting pin 354, and a plurality of resistance coils 356, 358, 360. The first and second conducting pins 352 and 354 extend in a first direction X and are parallel to other. The plurality of resistive coils 356, 358, 360 are disposed between the first and second conducting pins 352, 354 and are aligned along the first direction X to define a plurality of heating zones A, B and C. The resistive coils 356, 358 and 360 each have a first end 362 connected to the first conducting pin 352 and a second end 364 connected to the second conducting pin 354. Therefore, the plurality of resistive coils 356, 358, 360 are connected to the first and second conducting pins 352, 354 to form parallel circuits. The resistive coils 356, 358, 360 may have the same/different pitches or the same/different outside diameters, or any combination thereof to provide a desired heating profile. For example, the resistance coils 356, 358, 360 may have a configuration similar to any of the resistance coils described in connection with the figures herein.

The resistance coil described in any of the forms of the present disclosure can be configured to have a plurality of portions having a constant pitch, a variable pitch, a constant diameter, a variable diameter or any combination thereof. Therefore, the resistance coil can be configured to provide a desired heating profile, taking into consideration factors that affect the heating profile, such as proximity to heat sinks, temperature distribution of the fluid to be heated, etc. By properly configuring the resistance coil, only one heater with only one resistance coil can be used to provide the desired heating profile, whether uniform or non-uniform heating profile. Alternatively, a heater may include multiple resistance coils with constant/variable pitches and constant/variable diameters to provide a desired heating profile.

Figure 11:
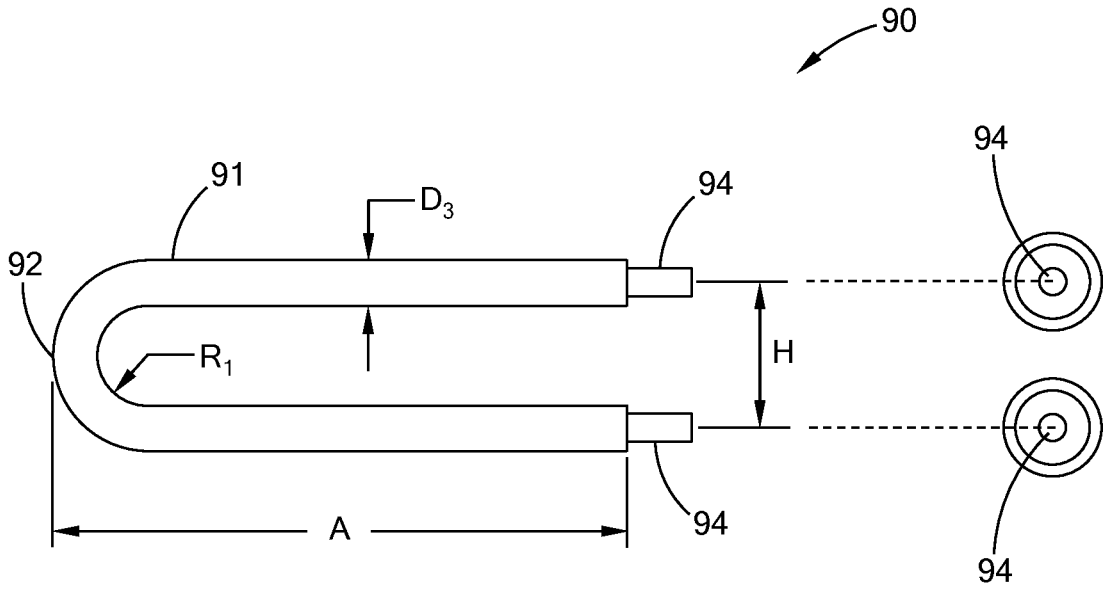
FIG. 11 is a plan view and a side view of a variant of a tubular heater constructed in accordance with the teachings of the present disclosure.

Referring to FIG. 11, a variant of a tubular heater 90 constructed in accordance with the teachings of the present disclosure is shown to define a U shape and include a hairpin bend 92. (It should also be understood, that any bend configuration such as a 45° or 90° bend may be employed as a variant of the tubular heater 90, and thus the 180° hairpin configuration should not be construed as limiting the scope of the present disclosure). The variable-pitch configurations as set forth above may be employed within this hairpin bend 92 portion in order to reduce current crowding. The tubular heater 90 may be used in direct type electric heat exchangers (shown in FIGS. 8 and 9) or indirect type electric heat exchangers.

As shown, the tubular heater 90 includes a tubular outer sheath 91 defining the hairpin bend 92, and a pair of conducting pins 94 protruding from opposing ends of the tubular outer sheath 91. The pair of conducting pins 94 are arranged in parallel and spaced apart by a distance H. The hairpin bend 92 has a curvature that defines a radius R. The tubular outer sheath 91 has an outside diameter of $D_3$. The tubular heater 90 includes a resistance coil (not shown in FIG. 7), which may have zoned-pitches as shown in FIG. 2 or continuously-variable pitches as shown in FIG. 3.

Figure 12:
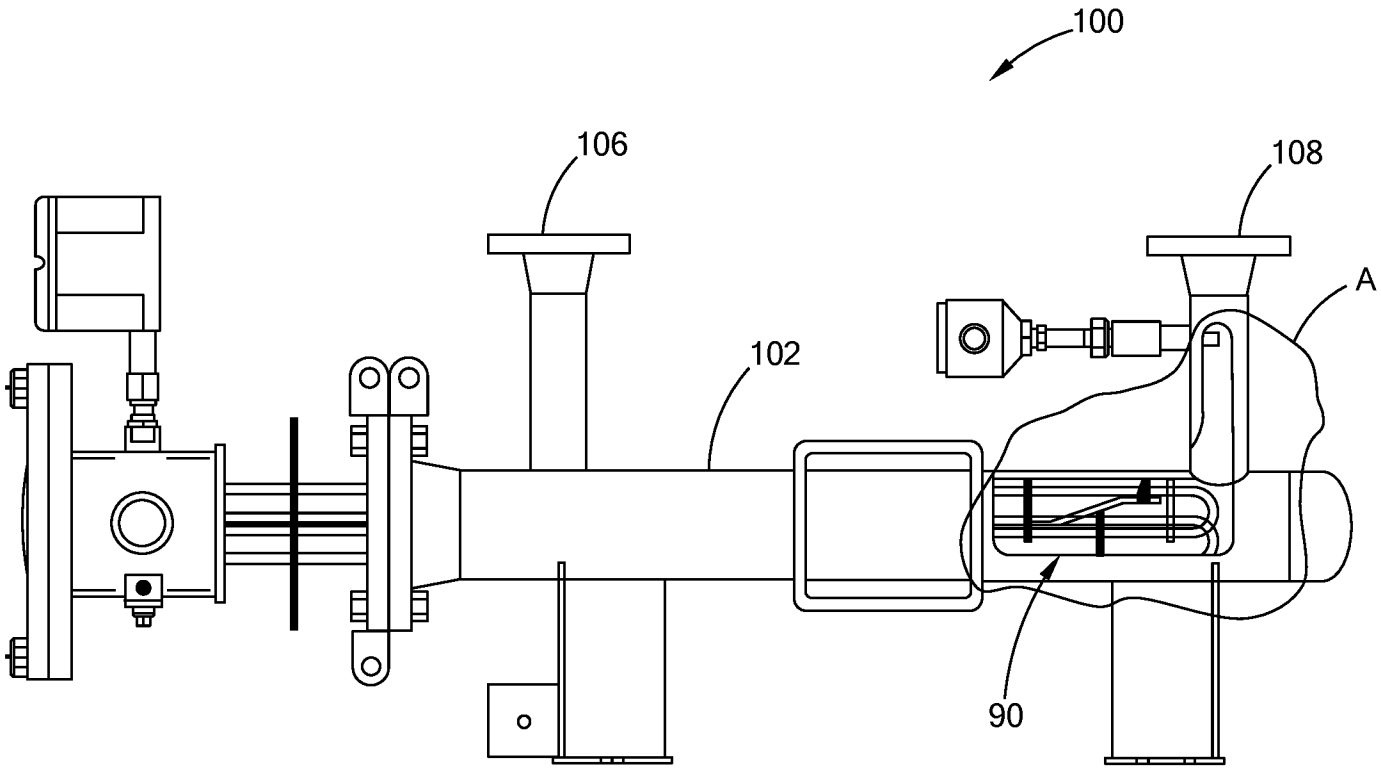
FIG. 12 is a side view of an electric heat exchanger that employs a tubular heater constructed in accordance with the teachings of the present disclosure.

Referring to FIG. 12, a heat exchanger that includes a plurality of tubular heaters 90 is shown and generally indicated by reference numeral 100. The heat exchanger 100 is a direct electric heat exchanger, which includes an outer tube 102 surrounding a plurality of tubular heaters 90. The outer tube 102 includes an inlet 106 and an outlet 108. The fluid to be heated flows in and out the outer tube 102 through the inlet 106 and the outlet 108.

Figure 13:
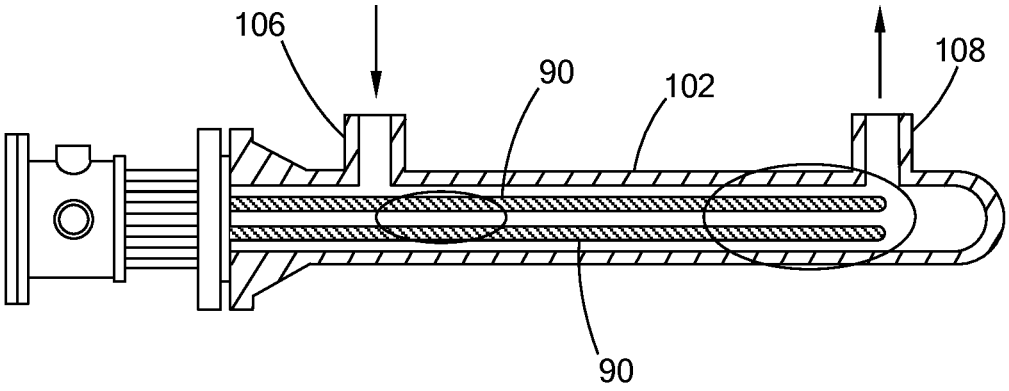
FIG. 13 is a partial cross-sectional view of the electric heat exchanger of FIG. 12.

Referring to FIG. 13, the tubular heaters 90 extend from the inlet 106 to the outlet 108 and have hairpin bends 92 disposed proximate the outlet 108. As the fluid enters the inlet 102, the fluid is gradually heated by the tubular heaters 90 until the fluid leaves the outer tube 102 through the outlet 108. The fluid proximate the inlet 106 is cooler than the fluid proximate the outlet 108.

In a typical direct heat exchanger, the tubular heaters have constant-pitch resistance coils in order to provide constant heat flux density (i.e., watt density) along the length of the outer tubular sheaths of the tubular heaters. The watt density is normally specified or calculated to limit the maximum sheath temperature for purposes of preventing degradation of the heated medium, and/or to achieve a desired heater durability, and/or for other safety reasons. Since the watt density is constant along the length of the tubular heaters, the sheath temperature varies depending on a number of thermodynamic factors, including the temperature gradient of the fluid along the tubular heaters, the flow rate of the fluid.

The heat exchangers that employ the typical tubular heaters generally have performance problems such as increased hydrocarbons and "coking" at the outlet. The fluid proximate the inlet is cooler than the fluid proximate the outlet. When the typical tubular heater provides uniform heating along the length of the tubular heater, the fluid proximate the inlet may not be heated rapidly enough, whereas the fluid proximate the outlet may be overheated, resulting in increased hydrocarbons and "coking" at the outlet. By using the resistance coil having variable pitch, the tubular heater may be designed to generate more heat proximate the inlet, and less heat proximate the outlet. Therefore, the heat exchangers that include the resistance coils of the present disclosure can rapidly increase the temperature of the fluid without overheating the fluid at the outlet.

Moreover, the tubular heater constructed in accordance with the teachings of the present disclosure can be installed in an existing heat exchanger to change the heating profile if desired. Engineering mistakes may be made when heat exchangers are designed, such as a mistake in the kilowatt rating being too low. The tubular heaters of the present disclosure can replace the existing heaters to provide a higher kilowatt bundle in the same heat exchanger package/size/footprint by changing the pitches of the resistance coil. Moreover, an existing prior art heater can be redesigned to provide a lower average watt density and/or sheath temperature, resulting in longer durability.

A tubular heater employing a resistance coil with continuously variable pitch generates a continuously variable watt density along the length of the outer tubular sheath. Therefore, the tubular heater of the present disclosure has the advantages of reducing the size of the tubular heater, and hence the heat exchanger, thereby reducing the manufacturing costs and footprint.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A heater comprising:

a first conducting pin;

a second conducting pin; and a plurality of resistance coils, each resistance coil including a first end connected to the first conducting pin and a second end connected to the second conducting pin, wherein at least one resistance coil of the plurality of resistance coils has a continuously variable pitch.

2. The heater according to claim 1, wherein the first and second conducting pins extend in a first direction and are parallel to each other.

3. The heater according to claim 2, wherein the plurality of resistance coils are disposed between the first and second conducting pins.

4. The heater according to claim 1, wherein one resistance coil of the plurality of resistance coils has a different diameter than another one of the resistance coils of the plurality of resistance coils.

5. The heater according to claim 1, wherein one of the resistance coils of the plurality of resistance coils has a different diameter and a different pitch than another one of the resistance coils of the plurality of resistance coils.

6. The heater according to claim 1, wherein each resistance coil of the plurality of resistance coils has a variable pitch from its respective first end to its respective second end.

7. The heater according to claim 1, wherein one of the resistance coils of the plurality of resistance coils has a variable diameter.

8. The heater according to claim 1, wherein one of the resistance coils of the plurality of resistance coils has a variable diameter and a variable pitch.

9. The heater according to claim 1, wherein one of the resistance coils of the plurality of resistance coils has a constant diameter.

10. The heater according to claim 1, wherein each of the resistance coils of the plurality of resistance coils has a constant diameter.

11. The heater according to claim 1, wherein the plurality of resistance coils are aligned axially along a first direction to define a plurality of heating zones.

12. A heater comprising:

a first conducting pin;

a second conducting pin; and a plurality of resistance coils connected in a parallel circuit with the first and second conducting pins such that each resistance coil includes a first end connected to the first conducting pin and a second end connected to the second conducting pin, wherein the plurality of resistance coils are aligned along a first direction to define a plurality of heating zones, wherein a first resistance coil of the plurality of resistance coils has a continuously variable pitch or a diameter that is different than a second resistance coil of the plurality of resistance coils.

13. The heater according to claim 12, wherein the first and second conducting pins extend in the first direction and are parallel to each other, and wherein the plurality of resistance coils are disposed between the first and second conducting pins.

14. The heater according to claim 12, wherein the first resistance coil has a different diameter than the second resistance coil.

15. The heater according to claim 12, wherein each resistance coil of the plurality of resistance coils has a different diameter.

16. The heater according to claim 12, wherein the first resistance coil has a continuously variable pitch from its first end to its second end.

17. The heater according to claim 12, wherein each resistance coil of the plurality of resistance coils has a variable pitch from its respective first end to its respective second end.

18. The heater according to claim 12, wherein the plurality of zones includes at least three zones.

19. The heater according to claim 18, wherein the plurality of resistance coils are aligned axially along the first direction.

20. The heater according to claim 12, wherein at least one resistance coil of the plurality of resistance coils has a constant diameter.

* * * * *